US005967309A

United States Patent [19]

Robles-Gonzalez et al.

[11] Patent Number: 5,967,309

[45] Date of Patent: Oct. 19, 1999

[54] CONTAINER APPARATUS FOR SUBSTANCES SOLUBLE IN FLUID MEDIA AND METHOD FOR THE PREPARATION OF MIXTURES IN SITU

[76] Inventors: Pablo Andres Robles-Gonzalez, Calle 9 No. 12, Fraccionamiento La Quebrada, Cuatitlan Izcalli, Estado de Mexico; Luis Miguel Hernandez-Zamorano, Hector Saucedo No. 1824, Saltillo, Coahuila 25290, both of Mexico

[21] Appl. No.: 09/081,924

[22] Filed: May 20, 1998

[30] Foreign Application Priority Data

May 21, 1997 [MX] Mexico ..... 9703756

[51] Int. Cl.[6] ..... B65D 81/32

[52] U.S. Cl. ..... 206/221; 206/222; 215/6; 215/DIG. 8

[58] Field of Search ..... 206/219–222, 206/568; 215/6, 10, 256, DIG. 8

[56] References Cited

U.S. PATENT DOCUMENTS

| | | | |
|---|---|---|---|
| 4,024,952 | 5/1977 | Leitz | 206/221 |
| 4,203,517 | 5/1980 | Hildebrandt et al. | 206/221 |
| 4,614,267 | 9/1986 | Larkin | 206/221 |
| 4,793,475 | 12/1988 | Itzel | 206/221 |
| 4,903,828 | 2/1990 | Finke et al. | 206/221 |
| 5,419,445 | 5/1995 | Kaesemeyer | 206/220 |
| 5,465,835 | 11/1995 | Schumacher et al. | 206/221 |
| 5,472,106 | 12/1995 | Nofer | 215/256 |

*Primary Examiner*—Jim Foster
*Attorney, Agent, or Firm*—Sand & Sebolt

[57] ABSTRACT

The present invention refers to a container apparatus for substances soluble in fluid media, for the preparation of mixtures in a single container, and to a method for the preparation of mixtures thereof. The apparatus of the present invention is characterized by: threaded cover, an internal sleeve having a thread on the internal wall, and a recipient or container wall that in its external wall having a matching groove. The method comprising the steps of:

operating the closure means together with the fluid media container means through the internal sleeve means, thus allowing communication between the soluble substances and the fluid media inside the closed container, shaking the fluid media with the soluble means; and removing the closure means and pour the formulated mixture.

16 Claims, 3 Drawing Sheets

CONTAINER APPARATUS FOR SUBSTANCES SOLUBLE IN FLUID MEDIA AND METHOD FOR THE PREPARATION OF MIXTURES IN SITU

BACKGROUND OF THE INVENTION

Currently in the market there is a large amount of substances for mixing with liquids, which most often are provided with a cap having as sole purpose to impede spilling the liquid from the container.

For mixtures of this type it is needed to open the container carrying the liquid, to pour it in a second container and later on to add the substance to be mixed.

Otherwise the already prepared substances, have in their composition a great amount of preservatives, which for example, in the case of beverages, deteriorate both flavor as well as the nutritional value of the beverage. Among the already prepared substances are fruit juices, sodas, baby foods, malts, coffee, etc.

Sometimes the already prepared substances are formulated considering the activity loss until they reach the final user.

OBJECT OF THE INVENTION

An object of the present invention, is to solve both the problems of simplicity in the elaboration of mixtures, as well as eliminating as many conservatives as possible in products used by living beings, particularly in nutritious products, as decay is reduced when they are not in contact with water.

An object of the present invention is eliminating a third container for the elaboration of mixtures of soluble substances in fluid media particularly blended beverages.

An additional object of the present invention is to contain in a isolated manner, soluble products of fluid media for transportation and use, formulated without requiring to consider activity loss until reaching the final user, which is reflected in reduced dispensing of active substances.

Another object of the present invention relates to the method of preparation in situ of mixtures based in substances soluble in liquids, comprising the steps of:

operating the closure means together with the fluid media container means through internal sleeve means, thus allowing communication between the soluble substances and the fluid media inside the closed container, shaking the fluid media with the soluble means and removing the closure means to pour the formulated mixture.

BRIEF DESCRIPTION OF THE DRAWINGS

For a more complete understanding of the present invention, and further details and advantages thereof, now reference is made to the following detailed description taken together with the accompanying drawings, wherein.

DETAILED DESCRIPTION OF THE INVENTION

Figure 1:
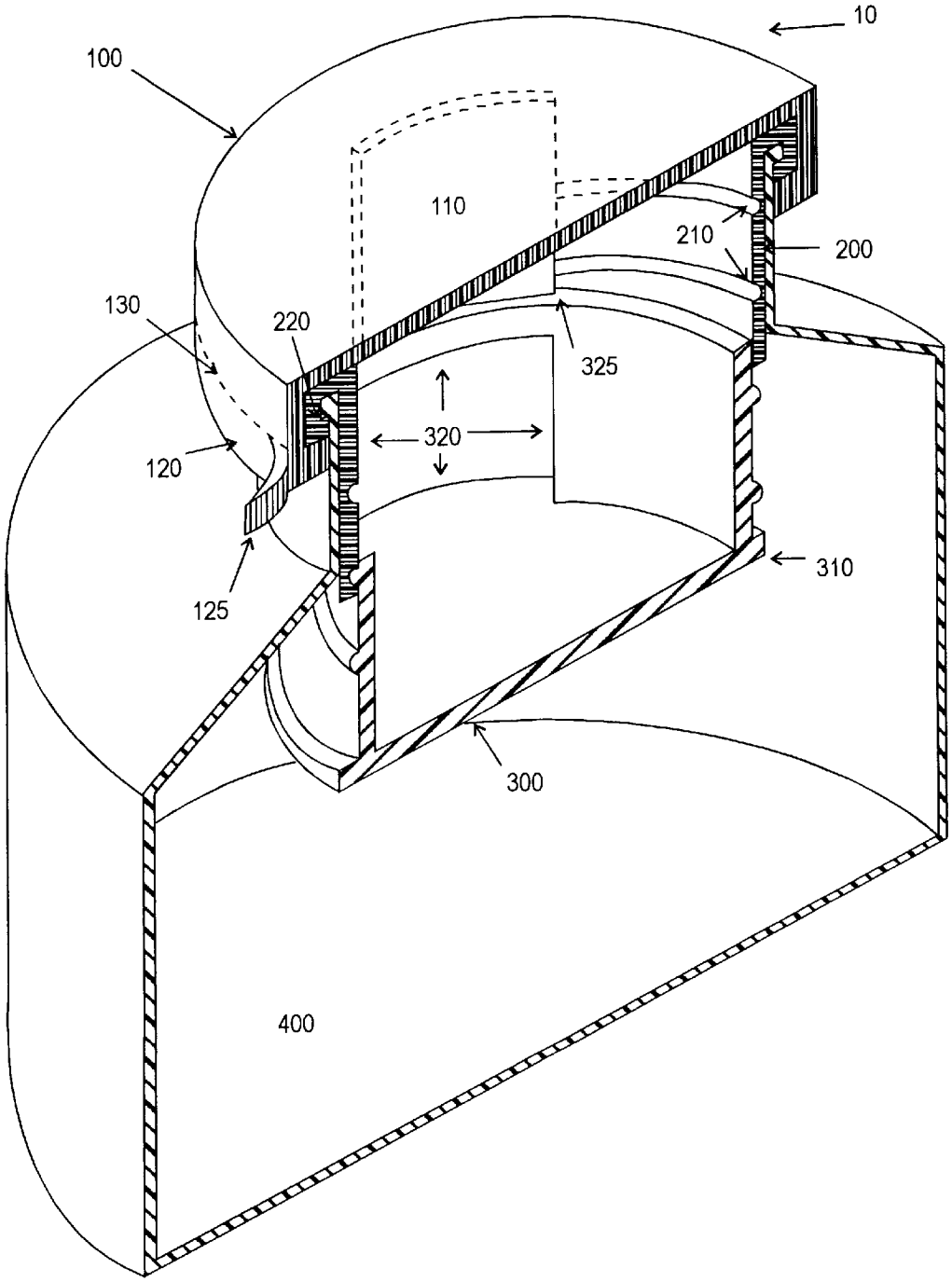
FIG. 1, is a cross sectional perspective view of the present invention in open mode.
Figure 2:
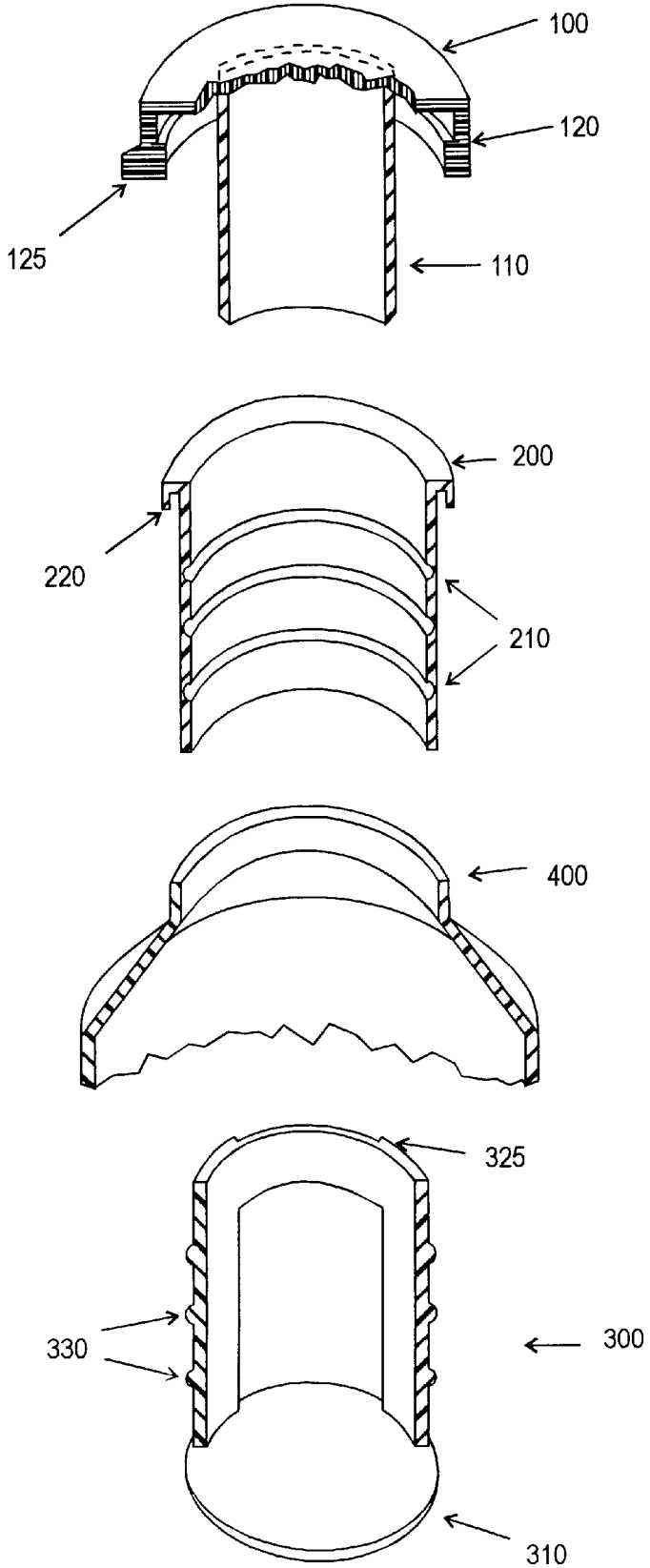
FIG. 2, is a exploded perspective view of the present invention.
Figure 3A:
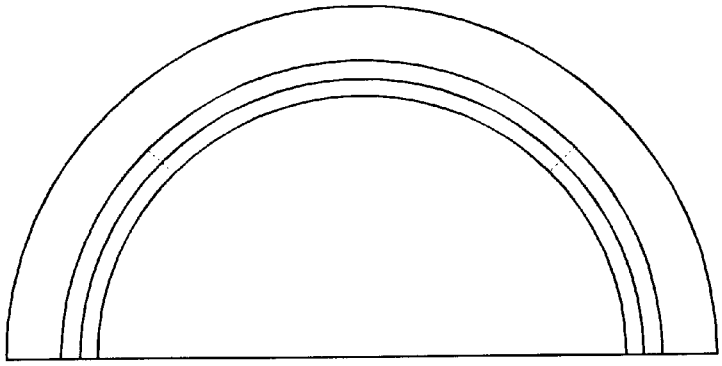
FIGS. 3*a* and 3*b*, are front elevation views of a cross section of the present invention, the open end of the container and a section of the container, respectively.
Figure 3B:
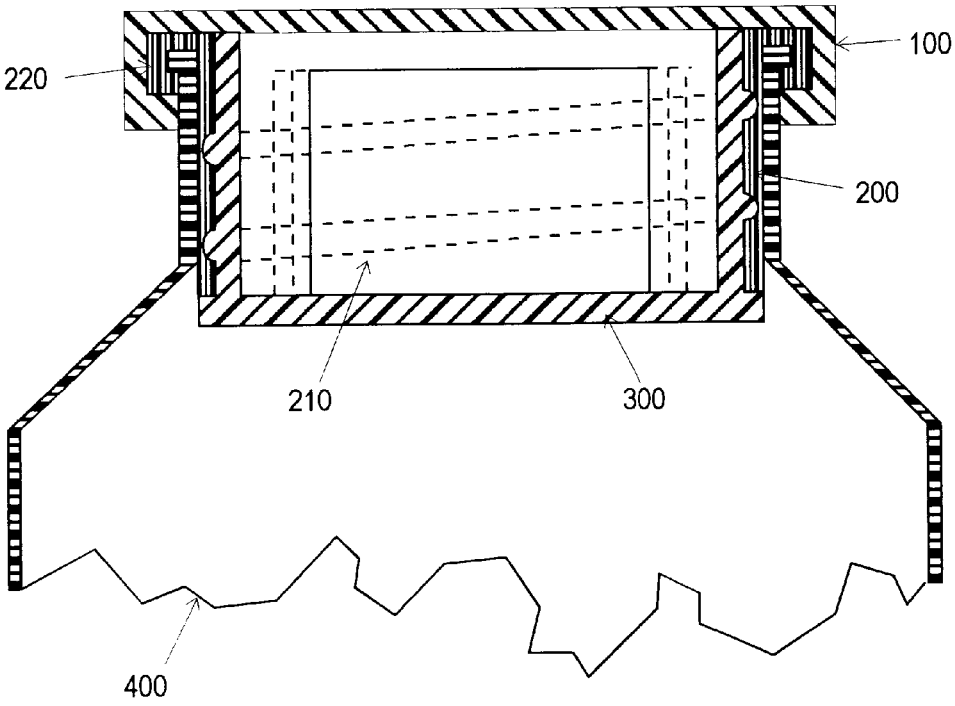

Making reference to the figures wherein same numbers represent same or similar parts:

FIG. 1, depicts the cap 10 subject of the present invention having a threaded cover 100, an internal sleeve 200 provided with a thread on the internal wall, and a container 300 having in its external wall a matching groove.

The threaded cover 100, has a press tab 110, a security belt 120 provided with a release tab 125; and a series of release openings 130. The internal sleeve 200, is provided with a thread 210 and a matching groove 220 between the container or recipient 400 and the cap 10. The container 300, has in its base an external profile 310, a release window 320 provided with guide means 325 in each one of the lateral profiles, in which slips the tab 110 of the threaded cover 100. To assemble the cap, the container 300 is coupled with the internal sleeve 200, by means of the thread and matching groove. Thereafter the container is filled with the soluble substance to mix and the threaded cover 100, is placed once assembled, the cap is placed in the container or recipient previously filled with the fluid media.

To open the cap, the top cover 100, is rotated which by means of the press tabs 110 coupled to the guides 325, of the windows 320, rotate the container 300, until the release windows 320, allow the contact of the liquid once with the aqueous means, that by shaking mixes with the soluble substance, once the mixing is carried out, the release tab 125 is pulled, to remove the security band 120, which is easily withdrawn with the help of the series of openings 130.

Although a preferred embodiment of the invention has been teached in the previous detailed description and illustrated in the accompanying drawings, it should be understood that the invention is not limited to the described embodiments, but rather it is able of numerous rearrangements, modifications and substitutions of parts and elements, without departing from the spirit of the invention. Thus the present invention is intented to cover such rearrangements, modifications and substitutions of parts and elements that fall within the scope of the invention defined by the attached claims.

It is noted that as to this date, the best method known by the applicant to take to the practice the mentioned invention, is the one evident from present description of the invention.

Having thus described the above invention, it is claimed as property that contained in the following:

1. A method for preparing mixtures of fluid medium and soluble substances, said method comprising the steps of: providing a recipient and a cap, the fluid medium being at least initially held in the recipient, the soluble substances being at least initially held in the cap, the cap being disposed on the recipient, the cap being selectively moveable between non-open and open modes, the cap including an inner sleeve, a cover, and a container, the cover including a press tab, the container including a base and an external wall, the external wall being fixedly attached to the base, the external wall being formed with at least a first release window and a guide, the press tab being adjustably received in the guide, the at least first release window being blocked by said press tab to prevent communication between the soluble substances and the fluid medium when the cap is in the non-open mode, the at least first release window being at least partially unblocked when the cap is in the open mode; operatively engaging the press tab with the guide to move the cap from the non-open position to the open position; allowing communication between the soluble substances and the fluid medium; and shaking the fluid medium with the soluble substances inside the recipient.

2. The method as set forth in claim 1, wherein the step of operatively engaging the press tab with the guide includes the step of rotationally engaging the press tab with the guide to cause the rotation of the container with respect to the inner sleeve.

3. In combination a recipient and a cap; comprising:

said recipient having an open end, the recipient adapted to selectively hold a fluid medium;

said cap disposed within the open end of said recipient, the cap adapted to selectively hold a soluble substance and to selectively retain the fluid medium within the recipient;

said cap including an internal sleeve, a container, and a cover;

the container having a base and an external wall fixedly attached to the base, said external wall being formed with at least a first release window;

the internal sleeve being disposed in the open end of said recipient and interposed between said recipient and said external wall of said container;

the cover being disposed across the internal sleeve;

said cap being selectively moveable between non-open and open modes, said cap adapted to retain the soluble substance therein when said cap is in the non-open mode and adapted to permit communication between the fluid medium and the soluble substance through the first release window when said cap is in the open mode.

4. The combination as set forth in claim 3, wherein said container is formed with a guide adjacent the first release window, and wherein the cover includes a press tab slidably received in said guide to prevent communication between the fluid medium and the soluble substance through said release window when said cap is in the non-open mode, said press tab adapted to permit communication through said release window between the fluid medium and the soluble substance when said cap is in the open mode.

5. The combination as set forth in claim 4, wherein said container is selectively rotatable with respect to said inner sleeve, said press tab rotationally engaging said guide to rotate said container with respect to said inner sleeve to move said cap between non-open and open modes.

6. The combination as set forth in claim 5, wherein one of said inner sleeve and said container is formed with a thread, and wherein the other of said inner sleeve and said container is formed with a groove, the thread and the groove being selectively threadable with one another, whereby said container is rotatable with respect to said inner sleeve.

7. The combination as set forth in claim 6, wherein said cover includes a release tab and a security band, the security band being selectively removable from said cover, the release tab selectively removing said security band from said cover, and said cover being selectively removable from the recipient when the security band is removed from the cover.

8. The combination as set forth in claim 3 wherein the fluid medium is a fluid.

9. The combination as set forth in claim 3 wherein the fluid medium is a gas.

10. The combination as set forth in claim 3 wherein the soluble substance is a powder.

11. The combination as set forth in claim 3 wherein the soluble substance is a concentrated liquid.

12. A cap for selectively holding a soluble substance, the cap being mountable on a recipient having an open end, said cap comprising:

an internal sleeve, the internal sleeve adapted to be disposed within the open end of the recipient;

a container having a base and an external wall, the external wall being fixedly attached to the base, said external wall being formed with at least a first release window disposed along a portion of said external wall;

said external wall of said container being disposed adjacent said internal sleeve;

a cover disposed across said inner sleeve;

said cap being selectively moveable between non-open and open modes to retain the soluble substance therein when said cap is in the non-open mode and to permit the soluble substance to flow out of said cap through the first release window when said cap is in the open mode.

13. The cap as set forth in claim 12, wherein the container is formed with a guide adjacent the first release window, and wherein the cover includes a press tab, the press tab being selectively slidably received in the guide to retain the soluble substance within said container when said cap is in the non-open mode and to permit the soluble substance to flow out of said cap through said first release window when said cap is in the open mode.

14. The cap as set forth in claim 13, wherein the container is selectively rotatable with respect to the inner sleeve, said press tab rotationally engaging said guide to selectively rotate said container with respect to said inner sleeve to move said cap between the non-open and open modes.

15. The cap as set forth in claim 14, wherein one of the inner sleeve and the container is formed with a thread and the other of said inner sleeve and said container is formed with a groove, the thread and the groove being selectively threadable with one another, said container being selectively threadably rotatable with respect to said inner sleeve.

16. The cap as set forth in claim 15, wherein the cover includes a release tab and a security band, the security band being selectively removable from said cover, the release tab selectively removing said security band from said cover, said cover adapted to be selectively removable from said recipient when said security band is removed from said cover.

* * * * *